US010076201B2

(12) United States Patent
Kim

(10) Patent No.: US 10,076,201 B2
(45) Date of Patent: Sep. 18, 2018

(54) CUP HOLDER

(71) Applicant: K&LAB CO., LTD., Anyang-si (KR)

(72) Inventor: Sung-Il Kim, Yongin-si (KR)

(73) Assignee: K&LAB CO., LTD., Anyang-si (KR)

( * ) Notice: Subject to any disclaimer, the term of this patent is extended or adjusted under 35 U.S.C. 154(b) by 0 days.

(21) Appl. No.: 15/108,679

(22) PCT Filed: Jan. 6, 2015

(86) PCT No.: PCT/KR2015/000081
§ 371 (c)(1),
(2) Date: Jun. 28, 2016

(87) PCT Pub. No.: WO2015/105307
PCT Pub. Date: Jul. 16, 2015

(65) Prior Publication Data

US 2016/0316949 A1 Nov. 3, 2016

(30) Foreign Application Priority Data

Jan. 13, 2014 (KR) ..... 10-2014-0004111

(51) Int. Cl.
*B65D 23/06* (2006.01)
*A47G 23/02* (2006.01)
*A47G 19/22* (2006.01)

(52) U.S. Cl.
CPC ..... *A47G 23/0216* (2013.01)

(58) Field of Classification Search
CPC ..... A47G 23/0216; B65D 23/06
USPC ..... 220/716, 717, 737, 738, 739; 215/392
See application file for complete search history.

(56) References Cited

U.S. PATENT DOCUMENTS 1,459,311 A * 6/1923 Ozlek ..... B65D 47/06 220/717
1,950,505 A * 3/1934 Matters ..... A47G 23/0266 220/737
3,972,453 A * 8/1976 Kapples ..... B65D 47/127 220/254.7

(Continued)

FOREIGN PATENT DOCUMENTS

KR 20030020154 3/2003
KR 100446656 9/2004

(Continued)

OTHER PUBLICATIONS

International Search Report—PCT/KR2015/000081 dated Mar. 23, 2015.

*Primary Examiner* — J. Gregory Pickett
*Assistant Examiner* — Niki M Eloshway
(74) *Attorney, Agent, or Firm* — Cantor Colburn LLP

(57) ABSTRACT

Provided is a cup holder including: a cylindrical body, which has inner sides or both inner sides and outer sides formed of a material for absorbing a beverage or preventing a flow of the beverage and into which an outer circumferential surface of a cup is inserted; and a contamination prevention panel extending from a predetermined portion of an upper side of the body to an opened end of the cup or a height corresponding to a coupling portion of a cup lid mounted on the opened end and absorbing the beverage leaking through a contact portion between the opened end and the coupling portion corresponding to a drinking portion or preventing a flow of the beverage.

4 Claims, 6 Drawing Sheets

(56) References Cited

U.S. PATENT DOCUMENTS 4,678,154 A * 7/1987 McFarland ..... A47K 1/08 220/737
5,823,384 A * 10/1998 Sartori de Zamparolo ..... B65D 17/165 220/717
6,286,709 B1 * 9/2001 Hudson ..... B65D 81/3874 220/739
6,412,686 B1 * 7/2002 Mahl ..... B65D 5/0281 220/738
6,637,616 B2 * 10/2003 Couto ..... B65D 17/165 220/717
7,614,523 B1 * 11/2009 Fixler ..... A47G 23/0216 215/392
2003/0038104 A1 * 2/2003 Heilner ..... A61J 9/08 215/392
2004/0200943 A1 * 10/2004 Rokov ..... A47G 23/0216 248/311.2
2006/0043097 A1 * 3/2006 Tulp ..... A47G 23/0216 220/737
2006/0219722 A1 * 10/2006 Benak ..... A47G 19/2216 220/575
2007/0205204 A1 * 9/2007 Novak ..... A47G 23/0216 220/737
2009/0050767 A1 * 2/2009 Stone ..... A47G 23/0216 248/311.2
2015/0150398 A1 * 6/2015 Bateman ..... A47G 23/0216 294/137
2016/0270575 A1 * 9/2016 Panone ..... A47G 21/145
2016/0309935 A1 * 10/2016 Chuang ..... A47G 23/0216

FOREIGN PATENT DOCUMENTS

KR 20090104402 10/2009
KR 2020100008331 8/2010
KR 2020100011199 11/2010

* cited by examiner

CUP HOLDER

TECHNICAL FIELD

The present invention relates to a cup holder that is mounted on a beverage cup, such as carry-out coffee, and safely grips the beverage cup, and more particularly, to a cup holder that prevents clothes from being contaminated by a beverage leaking through a coupling portion of a cup lid and a cup when the beverage is drunken using the cup lid mounted on the beverage cup.

BACKGROUND ART

Cup lids that cover an upper side of a beverage cup are generally used in the beverage cup for coffee that sells in a carry-out speciality store. These cup lids have a configuration in which they prevent a sloshing beverage from overflowing or being spilled from the beverage cup and cause the beverage cup to be safely carried and a beverage to be drunken through a hole of the cup lid.

That is, the conventional cup lid has a structure in which a small hole which a user puts to his/her mouth or into which the user puts a separate straw so as to drink the beverage, as disclosed in Korean Patent Laid-open Publication No. 2003-20154 and Korean Patent Registration No. 10-0446656.

However, because the conventional beverage cup is formed of resin or paper, such as pulp, the beverage cup has a cylindrical shape, and a connection portion of the beverage cup is essentially disposed in a vertical direction of the cup when the beverage cup is manufactured. Thus, a step height corresponding to the thickness of paper occurs in an opened end having the above connection portion.

Thus, even though a coupling portion of the cup lid is coupled to the opened end of the cup and the user drinks the beverage through a drinking hole of the cup lid, due to the step height that occurs in the opened end of the cup, a minute tolerance occurs in a contact portion between the opened end and the coupling portion such that, when the user drinks the beverage by directly putting the small hole to his/her mouth without using the straw, the beverage may leak.

Meanwhile, although the connection portion is not disposed at the opened end of the cup, a tolerance for coupling exists between the coupling portion of the cup lid and the opened end. Also, when complete mutual coupling is not performed, the beverage may leak into a corresponding portion.

Thus, when the above-described leakage occurs in a state in which the user does not recognize any leakage while drinking the beverage of the cup using the cup lid, the user's clothes may be contaminated by the beverage.

Technical Solution

The present invention provides a cup holder that is mounted on a beverage cup and safely grips the beverage cup, a predetermined portion of the cup holder extending to correspond to a coupling portion of a cup lid coupled to an opened end of the cup so that, when a beverage leaks through a contact portion between the opened end and the coupling portion, the leakage is absorbed or a flow of the beverage is prevented and thus contamination of clothes can be prevented.

According to an aspect of the present invention, a cup holder includes: a cylindrical body, which has inner sides or both inner sides and outer sides formed of a material for absorbing a beverage or preventing a flow of the beverage and into which an outer circumferential surface of a cup is inserted; and a contamination prevention panel extending from a predetermined portion of an upper side of the body to an opened end of the cup or a height corresponding to a coupling portion of a cup lid mounted on the opened end and absorbing the beverage leaking through a contact portion between the opened end and the coupling portion corresponding to a drinking portion or preventing a flow of the beverage.

Here, the contamination prevention panel may have a length of an arc corresponding to an angle in the range of 45° to 180°.

In addition, the contamination prevention panel may include uneven portions formed at inner sides of the contamination prevention panel and preventing a flow of the leaking beverage.

In addition, the uneven portions may be formed in a horizontal or diagonal direction.

BEST MODE OF THE INVENTION

The present invention will now be described more fully with reference to the accompanying drawings, in which exemplary embodiments of the invention are shown.

Figure 1:
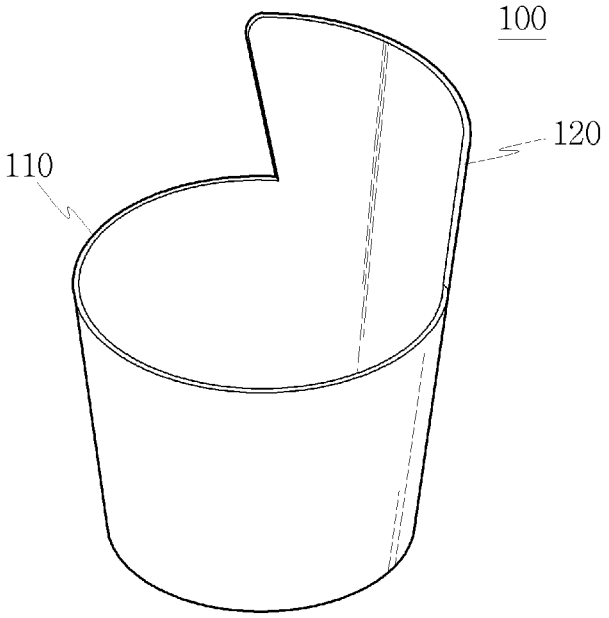
FIGS. 1 through 3 are respectively a perspective view, a side cross-sectional view, and a usage-state side cross-sectional view of a cup holder according to an exemplary embodiment of the present invention.
Figure 2:
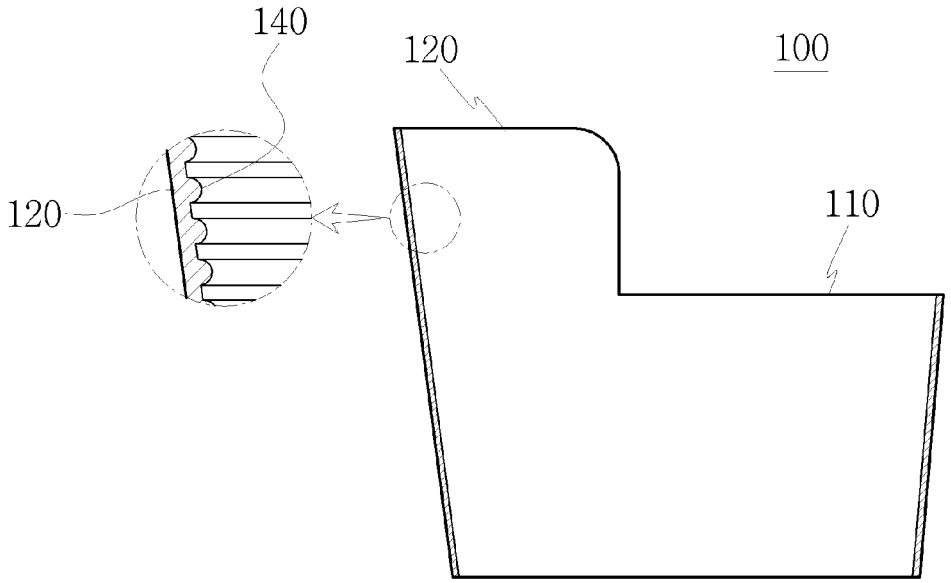
Figure 3:
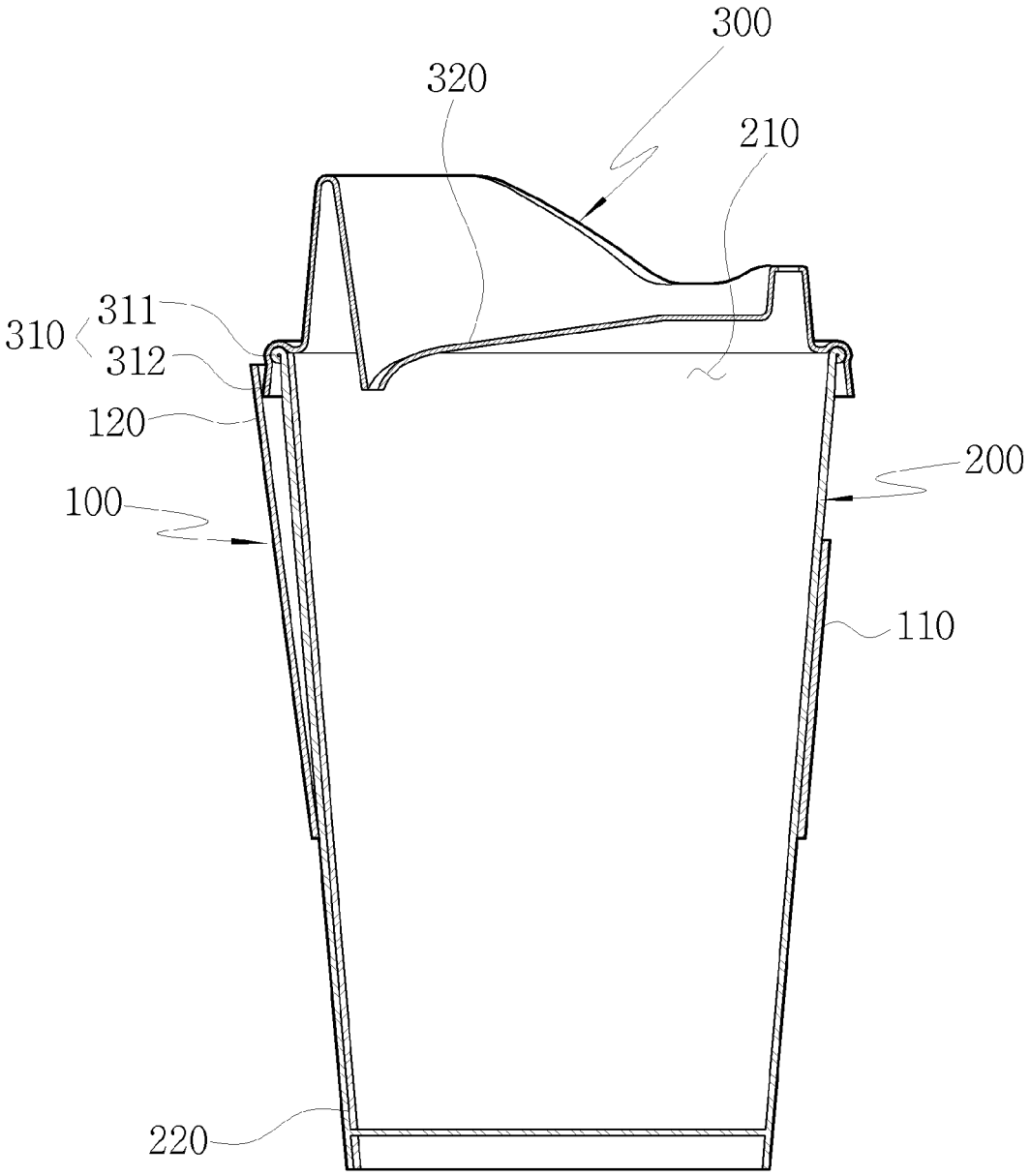
Figure 4:
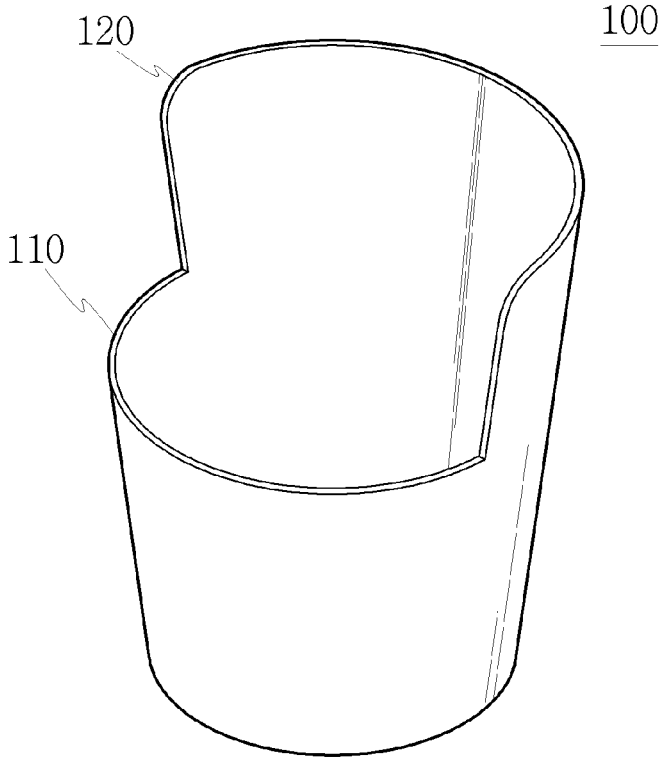
FIGS. 4 and 5 are perspective views of another shape of the cup holder according to the exemplary embodiment of the present invention.
Figure 5:
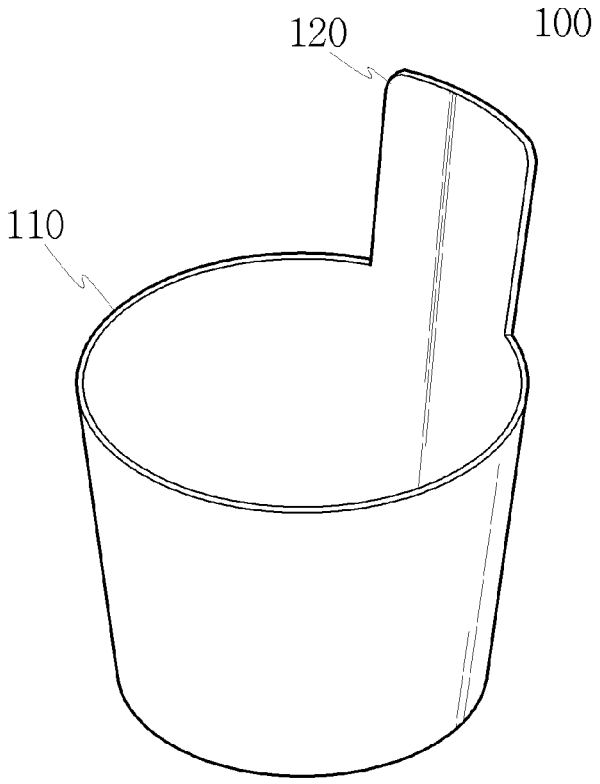
Figure 6:
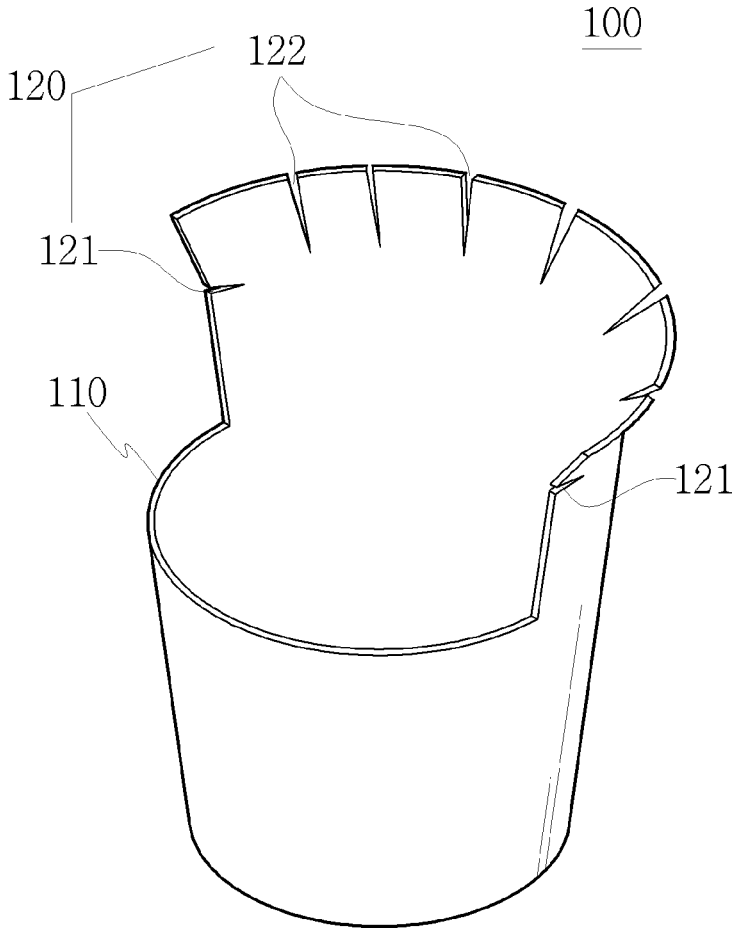
FIG. 6 is a perspective view of a cup holder according to a modified example of the exemplary embodiment of the present invention.

As illustrated in FIGS. 1 through 6, a cup holder 100 according to an exemplary embodiment of the present invention includes a cylindrical body 110, which has inner sides or both inner sides and outer sides formed of a material for absorbing a beverage or preventing a flow of the beverage and into which an outer circumferential surface of a cup 200 is inserted, and a contamination prevention panel 120 that has a circular arc having a predetermined length or an arc of a semicircle at an upper side of the body 110, extends to an opened end 210 of the cup 200 or to a height corresponding to a coupling portion 310 coupled to the opened end 210 when a cup lid 300 is mounted on the opened end 210, and absorbs the leaking beverage through a coupling portion of the opened end 210 corresponding to a portion which a user drinks the beverage by directly putting to his/her mouth and the coupling portion 310, or prevents a flow of the beverage.

Here, the cup 200 has a space in which the beverage is accommodated, and the user can drink the beverage through the opened end 210 at an upper side of the cup 200, and when the cup 200 is formed of resin or paper, the cup 200 may have a well-known configuration and function manufactured to have a corresponding shape due to a connection portion 220 and thus, a detailed description thereof will be omitted.

Also, the cup lid 300 has the coupling portion 310 that is formed at an edge of a cover portion 320 that covers the opened end 210 of the cup 200, is coupled to an edge of the opened end 210 of the cup 200 and prevents leakage of the beverage. More preferably, the cup lid 300 may further include a beverage guide portion that is formed between the cover portion 320 and the coupling portion 310, is elevated to have a predetermined height, provides a cooling space of the beverage and guides the beverage to the user's mouth so that the beverage can be easily taken, and one or more beverage discharge portions that are formed at the cover portion and the beverage guide portion and discharge the beverage to be accommodated in the cooling space or cause all of the remaining beverage to be discharged to a portion that faces the cooling space.

Here, the coupling portion 310 includes a coupling port 311 that is attachably/detachably coupled to or separated from the edge of the opened end 210 of the cup 200 by surrounding an outer portion of the edge of the opened end 210 of the cup 200 and prevents the beverage from leaking, and a skirt 312 that extends from a lower side of the coupling port 311 and causes the coupling port 311 and the edge to be easily attached to/detached from each other.

The body 110 that is a cylindrical gripping unit having a hollow portion into which the outer circumferential surface of the cup 200 is inserted, may be inserted into the conventional carry-out cup 200 and may provide an insulation function as well as heat reserving and cold reserving functions so that the user can more easily grip the cup 200.

The contamination prevention panel 120 that is a contamination prevention unit for preventing clothes from being contaminated by absorbing the leaking beverage through the connection portion 220 or preventing a flow of the beverage, has a circular arc having a predetermined length or an arc of a semicircle at the upper side of the body 110, extends to the opened end 210 of the cup 200 or to the height corresponding to the coupling portion 310 coupled to the opened end 210 when the cup lid 300 is mounted on the opened end 210, and absorbs the leaking beverage through the coupling portion of the opened end 210 corresponding to the portion which the user drinks the beverage by directly putting to his/her mouth and the coupling portion 310, or prevents a flow of the beverage.

That is, the contamination prevention panel 120 extends to the opened end 210 of the cup 200, the height corresponding to the coupling portion 310 of the cup lid 300 coupled to the opened end 210, or a greater height than the coupling portion 310 of the cup lid 300 by a predetermined length while having the length of an arc corresponding to the range of an angle of 45° to 180°, as illustrated in FIGS. 1 through 4. Thus, the leaking beverage, unknown to the user, due to the conventional problems is absorbed or a flow of the beverage is prevented and contamination of clothes can be prevented.

Here, the body 110 and the contamination prevention panel 120 having inner sides or both inner sides and outer sides formed of resin or paper for absorbing the beverage or preventing a flow of the beverage. More preferably, the inner sides contacting the outer circumferential surface of the cup 200 are formed of resin, such as sponge, or paper, such as corrugated paper, for absorbing the beverage, and the outer sides are film-coated not to be wet by the beverage. Thus, various advertising phrases are printed on the outer sides so that an advertising effect can be provided.

In addition, uneven portions 140 for improving a contact force with the cup 200 and absorbing the leaking beverage are further formed at the inner sides of the body 110 and the contamination prevention panel 120. The uneven portions 140 may be formed in vertical, horizontal, and diagonal directions. More preferably, the uneven portions 140 may be formed in the horizontal and diagonal directions so as to suppress the flow of the beverage that is not absorbed, as much as possible.

Meanwhile, the contamination prevention panel 120 has the length of an arc corresponding to the range of an angle of 45° to 180° at the upper side of the body 110 and has the length corresponding to the opened end 210 of the cup 200 so that, in comparison with the length of an arc corresponding to an angle of 360°, the user checks whether the cup lid 300 is normally mounted on the opened end 210, by the naked eyes so that leakage of the beverage due to abnormal mounting of the cup lid 300 can be prevented in advance.

In addition, the contamination prevention panel 120 may further include a pair of first cutting lines 121 cut to a predetermined length at an inclined angle at both edges of an upper side portion of the contamination prevention panel 120 and a plurality of second cutting lines 122 cut to a predetermined length at a perpendicular angle while having predetermined intervals between upper ends of the contamination prevention panel 120. Thus, the upper side portion of the contamination prevention panel 120 may be bent at a predetermined angle toward an outside of the coupling portion 310 of the cup lid 300. Thus, when the outer circumferential surface of the cup 200 is inserted into the body 110 in a state in which the coupling portion 310 of the cup lid 300 is coupled to the opened end 210 of the cup 200, the upper side portion that contacts and covers the opened end 210 or the skirt 312 of the coupling portion 310 does not contact the coupling portion 310 of the cup lid 300 so that the cup lid 300 cannot be separated from or escape from the opened end 210.

Also, the contamination prevention panel 120 contacts and covers the opened end 210 or the skirt 312 of the coupling portion 310 while having a height corresponding to the opened end 210 of the cup 200 or a predetermined greater height than the height from the upper side of the body 110. Thus, even when the user directly drinks the beverage through a drinking portion having a drinking hole of the cup lid 300, the user's drinking may not be disturbed.

Hereinafter, an operation of the cup holder 100 according to the exemplary embodiment of the present invention will be described as below.

First, after the beverage is accommodated in an accommodation space of the cup 200, the coupling portion 310 of the cup lid 300 is coupled to the opened end 210 of the cup 200 so that the opened end 210 is closed.

Subsequently, the outer circumferential surface of the cup 200 is inserted into the inner sides of the body 110 of the cup holder 100 while being supported thereon so that the cup holder 100 provides an insulation function to the user. In this case, the contamination prevention panel 120 extending with a predetermined length of an arc at the upper side of the body 110 is disposed to correspond to the coupling portion 310 of the cup lid 300 so that the corresponding drinking portion is covered.

Thus, when the user drinks the beverage by directly putting to his/her own mouth through the corresponding drinking portion of the cup lid 300 and due to a tolerance between the coupling portion 310 of the cup lid 300 and the opened end 210 of the cup 200, the beverage leaks through the contact portion between the coupling portion 310 and the opened end 210 corresponding to the drinking portion, absorption or flow is prevented at the inner sides of the contamination prevention panel 120 so that clothes can be prevented from being contaminated.

Thus, according to the cup holder 100 described above, the contamination prevention panel 120 is disposed to extend from an upper predetermined portion of the body 110 to cover the coupling portion 310 of the cup lid 300 coupled to the opened end 200 of the cup 200 so that, when the beverage leaks through the contact portion between the opened end 210 and the coupling portion 310, the beverage is absorbed or a flow of the beverage is prevented so that contamination of clothes can be prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

According to the present invention, a contamination prevention panel extends from a predetermined portion of an upper side of a body of a cup holder to cover a coupling portion of a cup lid coupled to an opened end of a cup so that, when a beverage leaks through a contact portion between the opened end and the coupling portion, the beverage is absorbed or a flow of the beverage is prevented and contamination of clothes can be prevented.

The invention claimed is:

1. A combination of a cup and a cup holder, comprising:

a cup (200) which has a space, in which a beverage is accommodated, and an opened end (210) at an upper side thereof;

a cup lid (300) which covers the opened end (210) of the cup (200); and a cup holder (100) into which an outer circumferential surface of the cup (200) is inserted;

wherein the cup lid (300) comprises:

a cover portion (320) which covers the opened end (210) of the cup (200);

a coupling portion (310) which is formed at edges of the cover portion (320) and is coupled to the opened end (210) of the cup (210);

a beverage guide portion which is formed between the cover portion and the coupling portion, is elevated to have a predetermined height, provides a cooling space of the beverage and guides the beverage to a user's mouth; and one or more beverage discharge portions which are formed at the cover portion and the beverage guide portion, and discharge the beverage inside the cup, wherein the cup holder (100) comprises:

a cylindrical body (110), which has inner sides or both inner sides and outer sides formed of a material for absorbing the beverage or preventing a flow of the beverage and into which the outer circumferential surface of the cup (200) is inserted; and a contamination prevention panel (120) extending to the opened end (210) of the cup (200) or to a height corresponding to the coupling portion (310) of the cup lid (300) mounted on the opened end (210) and absorbing the beverage leaking through a contact portion between the opened end (210) and the coupling portion (310) corresponding to a drinking portion or preventing a flow of the beverage when the user drinks the beverage by putting the drinking portion to the user's mouth, wherein the contamination prevention panel (120) comprises uneven portions (140) formed at inner sides of the contamination prevention panel (120) and preventing a flow of the leaking beverage, and wherein the uneven portions (140) includes corrugations formed in a horizontal direction.

2. The combination of a cup and a cup holder of claim 1, wherein the contamination prevention panel (120) has a length of an arc corresponding to an angle in the range of 45° to 180°.

3. The combination of a cup and a cup holder of claim 1, wherein the contamination prevention panel (120) comprises a pair of first cutting lines (121) cut to a predetermined length at an inclined angle at both edges of an upper portion of the contamination prevention panel (120).

4. The combination of a cup and a cup holder of claim 1, wherein the contamination prevention panel (120) comprises a plurality of second cutting lines (122) cut to a predetermined length at a perpendicular angle while having predetermined intervals between upper ends of the contamination prevention panel (120).

* * * * *